US009061803B2

(12) United States Patent
Chen

(10) Patent No.: US 9,061,803 B2
(45) Date of Patent: Jun. 23, 2015

(54) STORAGE DISPLAY BOX

(71) Applicant: Lin Yun Chen, Tainan (TW)

(72) Inventor: Lin Yun Chen, Tainan (TW)

( * ) Notice: Subject to any disclaimer, the term of this patent is extended or adjusted under 35 U.S.C. 154(b) by 0 days.

(21) Appl. No.: 14/146,812

(22) Filed: Jan. 3, 2014

(65) Prior Publication Data

US 2015/0027923 A1 Jan. 29, 2015

(30) Foreign Application Priority Data

Jul. 25, 2013 (TW) ..... 102213985 U

(51) Int. Cl.
*B65D 5/50* (2006.01)
*B65D 43/18* (2006.01)
*B65D 6/00* (2006.01)

(52) U.S. Cl.
CPC ..... *B65D 43/18* (2013.01); *B65D 11/00* (2013.01)

(58) Field of Classification Search
USPC ..... 206/736, 751, 752, 756, 762, 764, 45.2, 206/45.23, 5, 6
See application file for complete search history.

(56) References Cited

U.S. PATENT DOCUMENTS 3,692,174 A * 9/1972 Ross ..... 206/45.22
4,856,856 A * 8/1989 Winstone ..... 206/756
2004/0016675 A1* 1/2004 Chang ..... 206/756

* cited by examiner

*Primary Examiner* — Jacob K Ackun
(74) *Attorney, Agent, or Firm* — Rosenberg, Klein & Lee

(57) ABSTRACT

A storage display box includes an upper body having a side with an edge pivotably connected to an edge of a side of a lower body. An engagement groove is defined in an outer side of the upper or lower body. An elongated plate is removably received in the engagement groove when the upper and lower bodies are in a closed position. An insertion groove is defined in an inner wall of the upper or lower body. When the upper and lower bodies are in an open position, a first toothed portion on the side of the upper body meshes with a second toothed portion on the side of the lower body, and the elongated member is removably engaged in the insertion groove. The upper and lower bodies in the open position form two legs. The elongated member engaged in the insertion groove supports an object in an inclined position.

4 Claims, 6 Drawing Sheets

STORAGE DISPLAY BOX

BACKGROUND OF THE INVENTION

The present invention relates to a box and, more particularly, to a box for both of receiving and displaying an object.

A shop selling commodities generally place a commodity on a display shelf or in a display window or a display box to show the features of the commodity while allowing consumers to watch or access. If a consumer is interested, the salesman removes the commodity from the display shelf, places it in a storage box, and hands the storage box to the consumer. A display shelf for display purposes and a storage box for receiving purposes are required, which causes a waste in resources and increases the costs, failing to meet the economical effect. Furthermore, the storage box can not provide the display function, nor can the display shelf provide the storage function.

BRIEF SUMMARY OF THE INVENTION

To solve the disadvantages of the prior art, a storage display box according to the present invention includes an elongated plate, an upper body, and a lower body. The upper body includes a first compartment having an opening. The upper body further includes an outer side and a side. The side of the upper body includes an edge and a first toothed portion. The lower body includes a second compartment having an opening. The lower body includes an outer side and a side having a second toothed portion. The side of the lower body includes an edge pivotably connected to the edge of the upper body. An engagement groove is defined in the outer side of one of the upper body and the lower body. The upper body and the lower body are pivotable relative to each other between a closed position and an open position. The upper body and the lower body together define a receiving space when in the closed position. The elongated plate is removably received in the engagement groove when the upper body and the lower body are in the closed position. The first toothed portion meshes with the second toothed portion when the upper body and the lower body are in the open position. The upper body and the lower body in the open position form two legs. An insertion groove is defined in an inner wall of one of the upper body and the lower body distant to the edges of the upper and lower bodies. The elongated member is removably engaged in the insertion groove when the upper body and the lower body are in the open position. A top face of the elongated member engaged in the insertion groove is adapted to support an object in an inclined position.

In a form shown, the engagement groove is defined in the upper body, and the insertion groove is defined in the lower body. The elongated member includes a face having a scale. The other face of the elongated member includes a face having a name of a user or a commodity, a trademark, or a drawing.

The present invention will become clearer in light of the following detailed description of illustrative embodiments of this invention described in connection with the drawings.

DETAILED DESCRIPTION OF THE INVENTION

Figure 1:
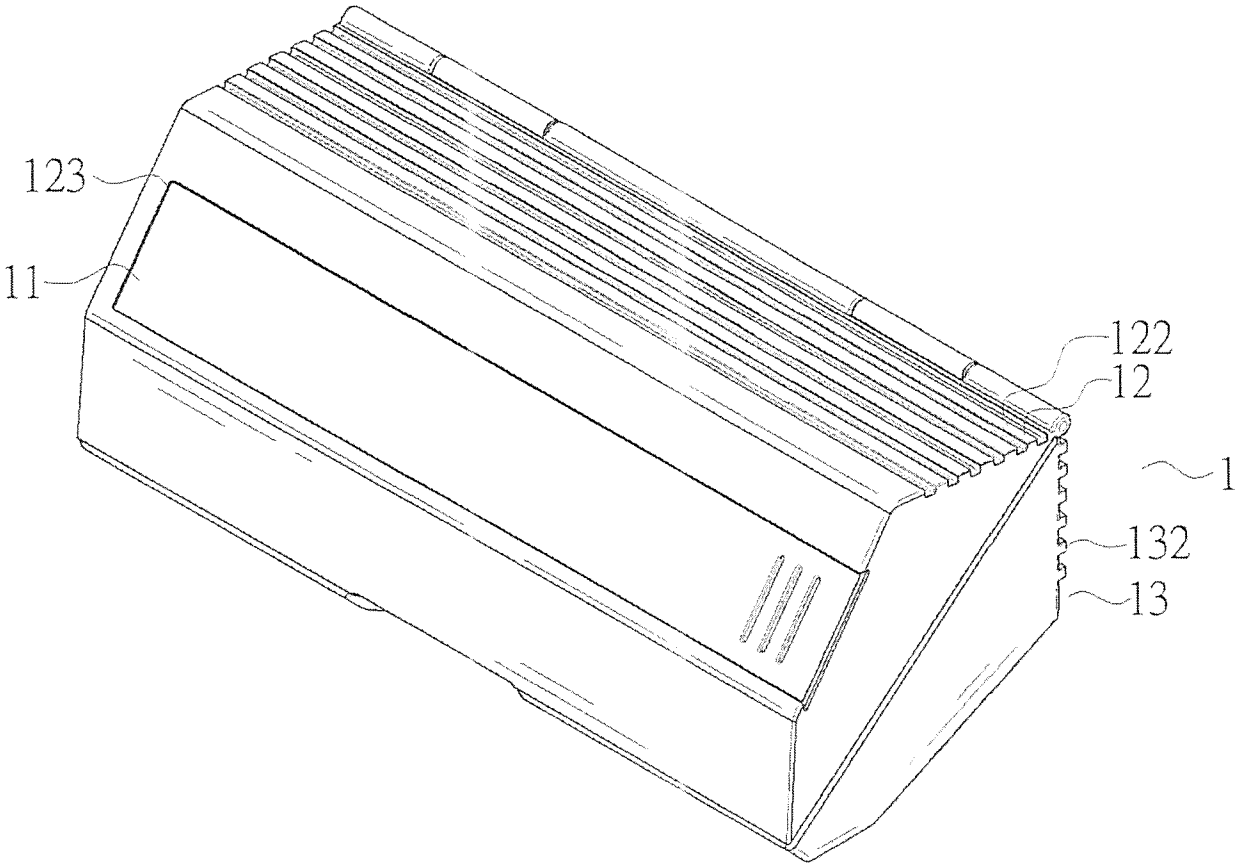
FIG. 1 is a perspective view of a storage display box according to the present invention, with the storage display box in a closed state.
Figure 2:
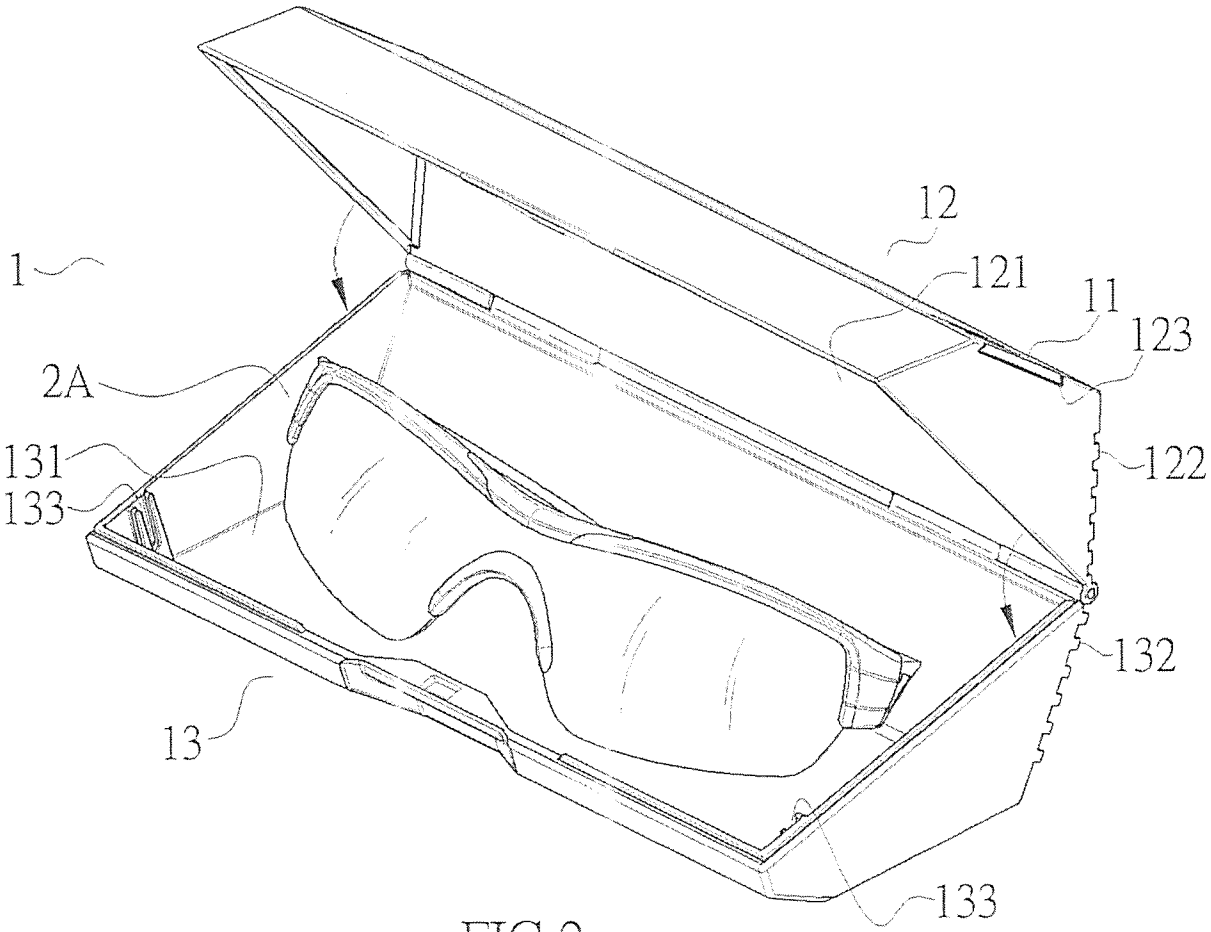
FIG. 2 is another perspective view of the storage display box of FIG. 1, with the storage display box partially opened, and with an object received in the storage display box.
Figures 3, 3A:
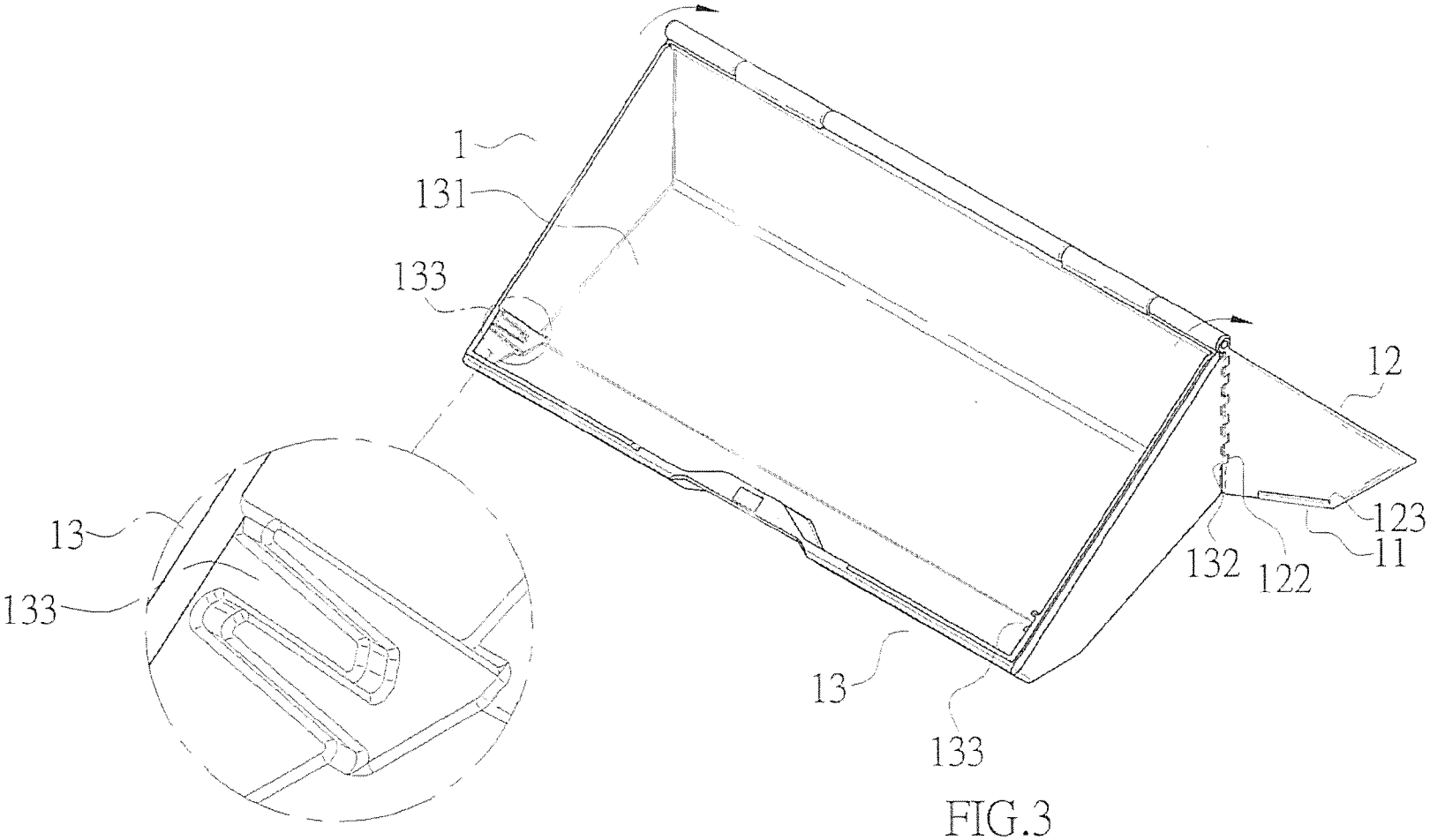
FIG. 3 is a further perspective view of the storage display box of FIG. 1, with the storage display box completely opened.
FIG. 3A is an enlarged view of a circled portion of FIG. 3.
Figure 4:
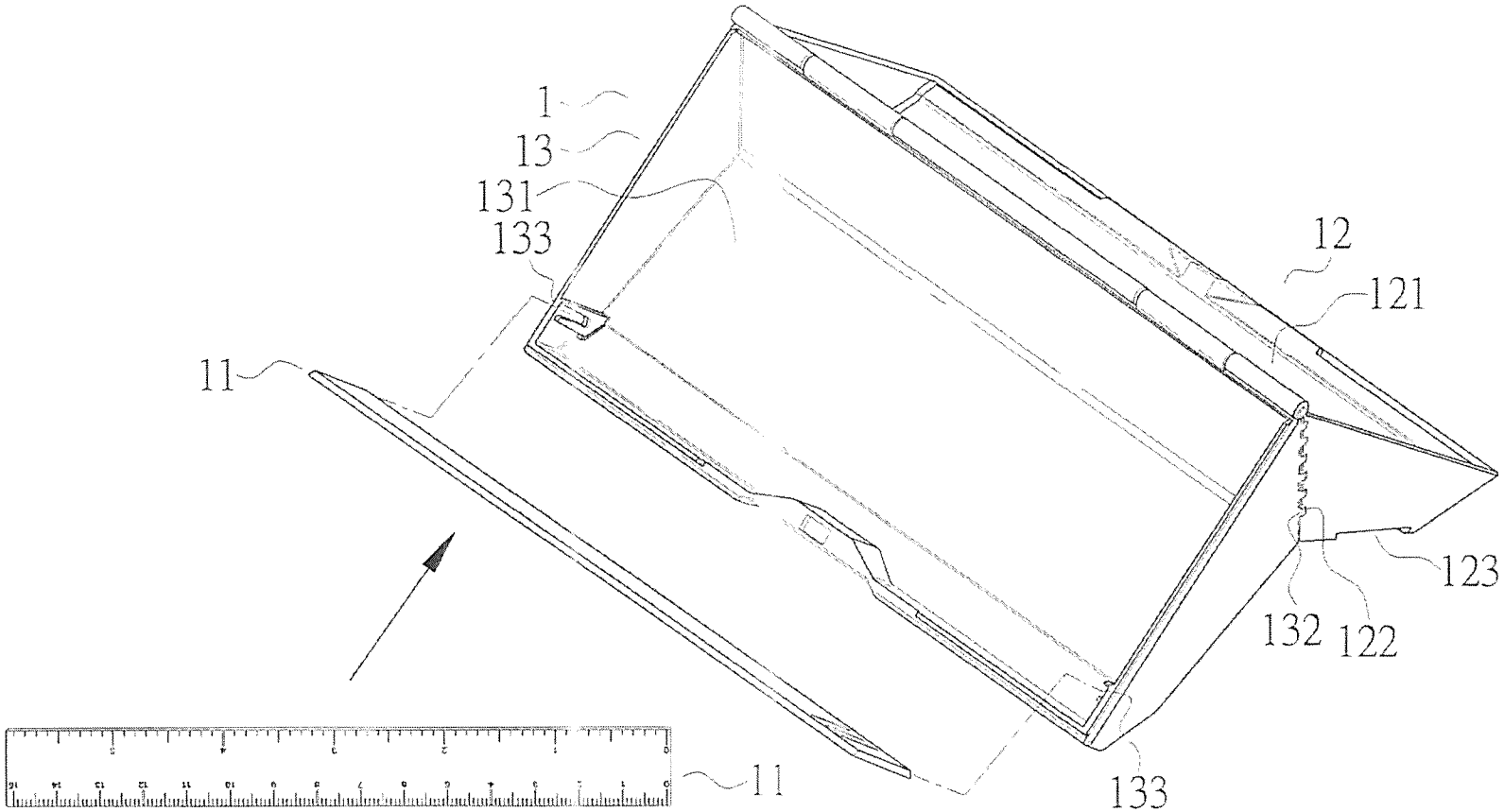
FIG. 4 is a perspective view similar to FIG. 3, illustrating insertion of an elongated plate.

With reference to FIGS. 1-6, storage display box 1 according to the present invention includes an elongated plate 11 having a face with a scale. The elongated plate 11 can be used as a ruler. The other face of the elongated member 11 can include a name of a user or a commodity, a trademark, or a drawing to increase the identification effect. With reference to FIGS. 1 and 4, the face with the scale faces downward, and the other face (with a trademark, for example) faces upward.

The storage display box 1 further includes an upper body 12 including a first compartment 121 having an opening. The upper body 12 further includes an outer side and a side. The side of the upper body 12 includes an edge and a first toothed portion 122.

The storage display box 1 further includes a lower body 13 including a second compartment 131 having an opening. The lower body 13 includes an outer side and a side having a second toothed portion 122. The side of the lower body 1 includes an edge pivotably connected to the edge of the upper body 123.

An engagement groove 123 is defined in the outer side of one of the upper body 12 and the lower body 13. An insertion groove 133 is defined in an inner wall of one of the upper body 12 and the lower body 13 distant to the edges of the upper and lower bodies 13, as shown in FIGS. 3 and 3A. In the form shown, the engagement groove 123 is defined in the upper body 12, and the insertion groove 133 is defined in the lower body 133.

The upper body 12 and the lower body 13 are pivotable relative to each other between a closed position and an open position. The upper body 12 and the lower body 13 together define a receiving space when in the closed position. The elongated plate 11 is removably received in the engagement groove 123 when the upper body 12 and the lower body 13 are in the closed position.

Figure 6:
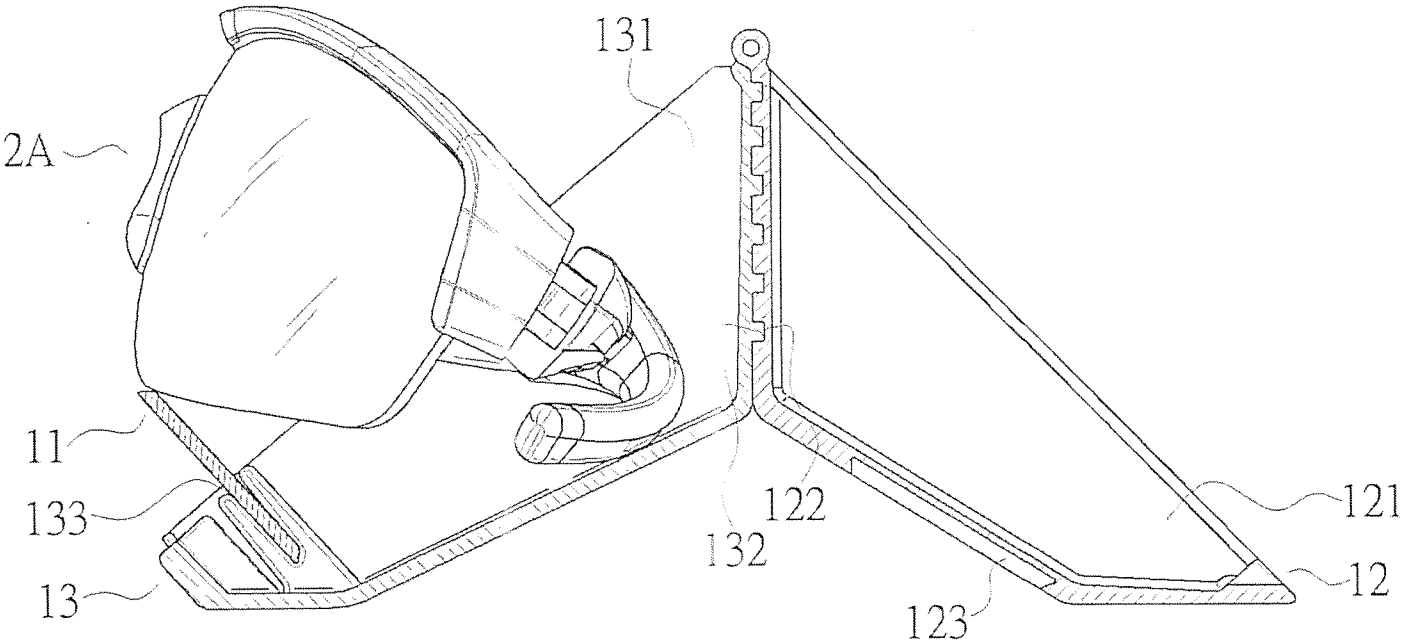
FIG. 6 is a cross sectional view of the open storage display box, with the object placed on a top face of the elongated plate.

The first toothed portion 122 meshes with the second toothed portion 123 when the upper body 12 and the lower body 13 are in the open position. The upper body 12 and the lower body 13 in the open position form two legs and, thus, can stably be placed on a table. The whole storage display box 1 in the open position is substantially inverted V-shaped. The elongated member 11 is removably engaged in the insertion groove 133 when the upper body 12 and the lower body 13 are in the open position. A top face of the elongated member 11 engaged in the insertion groove 133 is adapted to support an object (such as, but not limited to, a pair of glasses 2A) in an inclined position, as shown in FIG. 6.

In use, the upper and lower bodies 12 and 13 can be pivoted in a closing direction or an opening direction to provide the storage display box with a storage function and a display function according to needs. With reference to FIG. 2, when it is desired to use storage function, the upper and lower bodies 12 and 13 are pivoted in the closing direction to the closed position, the first and second compartments 121 and 131 of the upper and lower bodies 12 and 13 together form the receiving space for receiving the object, and the elongated plate 11 is removably engaged in the engagement groove 123.

Figure 5:
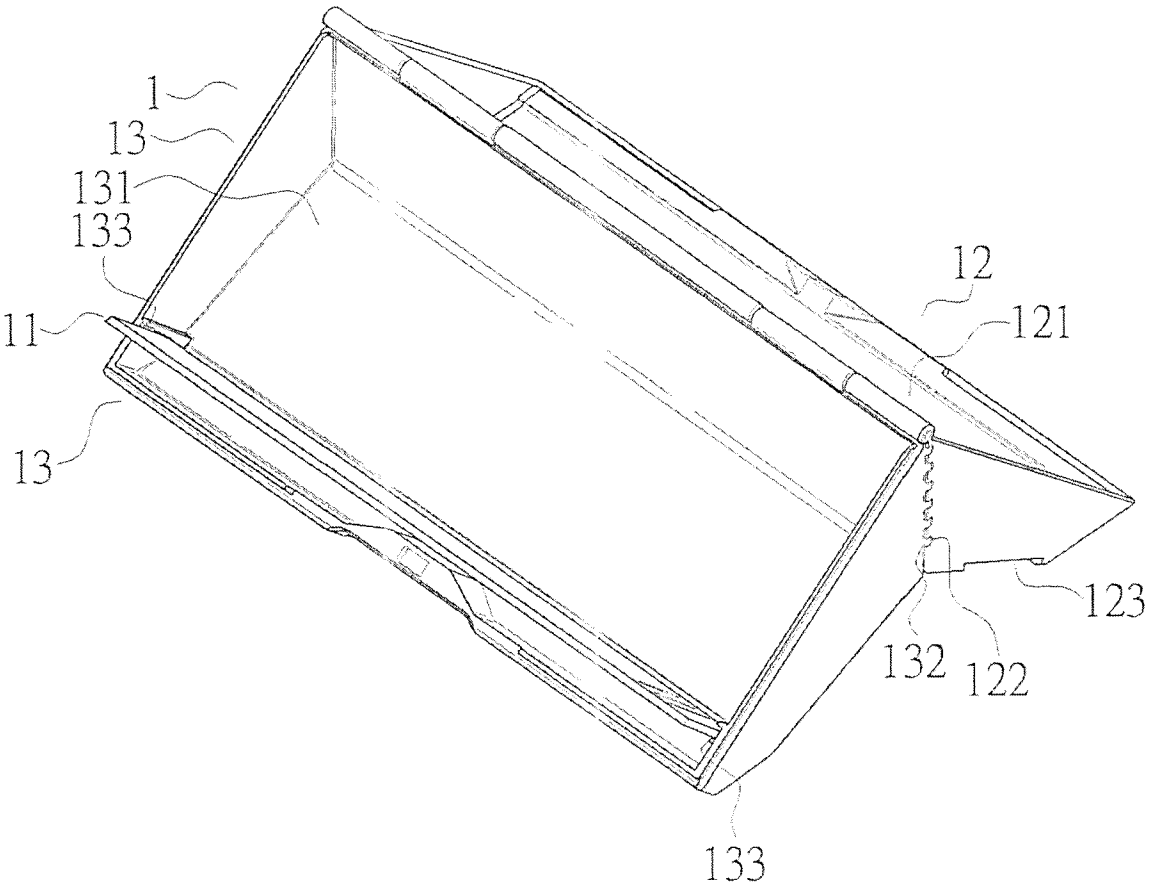
FIG. 5 is a perspective view similar to FIG. 4, with the elongated plate inserted in an insertion groove of the open storage display box.

When it is desired to use the display function, the upper and lower bodies 12 and 13 are pivoted in the opening direction to the open position in which the first and second toothed portions 122 and 132 mesh with each other. The elongated plate 11 is removably engaged in the insertion groove 133 (FIGS. 4 and 5). The top face of the elongated plate 11 supports the article in an inclined position for display purposes. The scale on the elongated member 11 can be used to show the length of the article so that the consumer can see whether the article is what he or she wants.

When the customer decides to buy the article displayed in the storage display box 1, the salesman can simply remove the elongated member 11 from the insertion groove 123 and place the elongated member 11 into the engagement groove 123. Then, the storage display box 1 can be closed and handed to the customer. Thus, an additional display shelf or storage box is not required, saving unnecessary costs and allowing simple operations.

Although specific embodiments have been illustrated and described, numerous modifications and variations are still possible without departing from the scope of the invention. The scope of the invention is limited by the accompanying claims.

The invention claimed is:

1. A storage display box comprising:

an elongated member forming a plate;

an upper body including a first compartment having an opening, with the upper body further including an outer side and a side, with the side of the upper body including an edge and a first toothed portion; and a lower body including a second compartment having an opening, with the lower body including an outer side and a side having a second toothed portion, with the side of the lower body including an edge pivotably connected to the edge of the upper body, with an engagement groove defined in the outer side of one of the upper body and the lower body, with the upper body and the lower body pivotable relative to each other between a closed position and an open position, with the upper body and the lower body together defining a receiving space when in the closed position, with the elongated plate removably received in the engagement groove when the upper body and the lower body are in the closed position, with the first toothed portion meshed with the second toothed portion when the upper body and the lower body are in the open position, with the upper body and the lower body in the open position forming two legs, with an insertion groove defined in an inner wall of one of the upper body and the lower body distant to the edges of the upper and lower bodies, with the elongated member removably engaged in the insertion groove when the upper body and the lower body are in the open position, and with a top face of the elongated member engaged in the insertion groove adapted to support an object in an inclined position.

2. The storage display box as claimed in claim 1, wherein the engagement groove is defined in the upper body, and the insertion groove is defined in the lower body.

3. The storage display box as claimed in claim 1, wherein the elongated member includes a face having a scale.

4. The storage display box as claimed in claim 1, wherein the elongated member includes a face having a name of a user or a commodity, a trademark, or a drawing.

* * * * *